US006431035B1

(12) United States Patent
Hendrikse et al.

(10) Patent No.: US 6,431,035 B1
(45) Date of Patent: Aug. 13, 2002

(54) WIRE WHEEL SPOKE TIGHTENING CLAMP APPARATUS AND METHOD

(76) Inventors: Karl J. Hendrikse, 941 Sommer Dr.; Chris J. Shermeister, 5621 Evergreen Dr., both of Sheboygan, WI (US) 53081

( * ) Notice: Subject to any disclaimer, the term of this patent is extended or adjusted under 35 U.S.C. 154(b) by 0 days.

(21) Appl. No.: 09/934,144

(22) Filed: Aug. 21, 2001

Related U.S. Application Data

(63) Continuation-in-part of application No. 09/658,554, filed on Sep. 8, 2000.
(60) Provisional application No. 60/153,541, filed on Sep. 13, 1999.

(51) Int. Cl.[7] ..... B25B 7/02

(52) U.S. Cl. ..... 81/417; 81/426

(58) Field of Search ..... 81/417, 420, 424.5, 81/426, 341, 342

(56) References Cited

U.S. PATENT DOCUMENTS

| | | | | |
|---|---|---|---|---|
| 73,289 | A | 1/1868 | Bounds | |
| 1,874,944 | A | 8/1932 | Fabian | |
| 2,004,524 | A | 6/1935 | Foeckler | 294/3 |
| 2,096,016 | A | 10/1937 | Weishampel | 81/87 |
| 2,395,988 | A | 3/1946 | Biles | 81/51.3 |
| 3,763,722 | A | 10/1973 | Ehrens | 81/3 J |
| 5,377,567 | A | 1/1995 | Sorensen | 81/426 |
| 6,023,833 | A | 2/2000 | Jacobsmeier | 29/450 |

*Primary Examiner*—Joseph J. Hail, III
*Assistant Examiner*—David B. Thomas
(74) *Attorney, Agent, or Firm*—Robert T. Johnson

(57) ABSTRACT

Mounting wire spokes in a wheel, such as on a bicycle, requires even tightening of each spoke, and to attain such even tightening, wire wheel spoke tightening clamp apparatus and method is disclosed to tightly hold the spoke adjacent to the spoke threaded section, by the spoke tightening clamp, while tightening the threaded nipple onto the spoke threaded threaded section to prevent twisting of the spoke, to thus attain a straight, non-wobbly wheel assembly.

3 Claims, 3 Drawing Sheets

WIRE WHEEL SPOKE TIGHTENING CLAMP APPARATUS AND METHOD

This is a continuation-in-part patent application for WIRE WHEEL SPOKE TIGHTENING CLAMP APPARATUS AND METHOD, with the prior application having Ser. No. 09/658,554, art unit #3723 filed Sep. 08, 2000; Title; TWIST-RESIST SPOKE CLAMP TOOL, and provisional application Ser. No. 60/153,541; filed Sep. 13, 1999; Title; TWIST-RESIST SPOKE CLAMP TOOL

BACKGROUND OF THE INVENTION

This invention of WIRE WHEEL SPOKE TIGHTENING CLAMP APPARATUS AND METHOD pertains to uniform wheel spoke tension in a wire wheel assembly of, for example, a bicycle wheel, to have a truly straight wheel rim without waves and to have a wheel and tire mounted thereon without wobble when mounted in a bicycle, and is attained by holding a spoke, to prevent spoke twisting when screwing the nipple mounted in the wheel rim, onto the threads of the spoke.

SUMMARY OF THE INVENTION

Disclosure is made of WIRE WHEEL SPOKE TIGHTENING CLAMP APPARATUS AND METHOD and the apparatus being a hand held clamp to hold the spoke tightly, to prevent spoke twisting when the nipple mounted in the wheel rim, screws onto the spoke threads, The method consists of holding the spoke tightly, adjacent to the spoke threads, while the nipple screws onto the spoke threads.

PRIOR ART PATENTS

U.S. Pat. No. 6,023,833 for FASTENER CLIP TOOL. This patent discloses a tool to grab a fastener clip.

U.S. Pat. No. 5,377,567 for BICYCLE TOOL. This patent discloses a hand tool, such as locking pliers for adjustment of a variety of fasteners, which are part of a bicycle, and could be used as a spoke wrench.

U.S. Pat. No. 3,763,722 for GRIPPING AND PULLING TOOL FOR RETRACTING GUIDE TAPES FROM CONDUIT. This is for alignment of the tape length wise of the tool.

U.S. Pat. No. 2,395,988 for WRENCH. Disclosure is made of a wrench for turning packing nuts in a plurality of rows of tubes.

U.S. Pat. No. 2,096,016 for WRENCH. This is for a closed end adjustable wrench.

U.S. Pat. No. 1,874,944 for BATTERY TOOL. Disclosure is made of a tool having gripping jaws having "teeth (15) on the jaw 11 are inclined at an angle - - - " (see lines 46–48, page 1)

U.S. Pat. No. 73,289 for PLIERS. Disclosure is made of a movable jaw and a sliding shank.

None of the above cited patent references, either singly or collectively, disclose matter claimed in this application that would preclude issuance of a patent thereon.

DRAWING LEGEND DESCRIPTIONS

| LEGEND NUMBER | DESCRIPTION |
|---|---|
| 1 | Spring mount pin on fixed handle. |
| 2 | Spring mount pin on pivot lever arm. |
| 3 | Spoke e11 mount to fit in hole in hub plate. |
| 4 | Fastener or rivet to attach fixed handle to tie plate. |
| 5 | Rim of spoke wheel. |
| 6 | Threaded nipple to attach to thread of spoke. |
| 7 | Spoke. |
| 8 | Hub and hub plate of spoke wheel |
| 9, 9' | Pivoting lever arm. |
| 10 | Pivot pin of lever arm. |
| 11 | Lever arm stop guide. |
| 12 | Tension spring. |
| 13 | Finger grip on fixed handle. |
| 14 | Thumb grip. |
| 15 | Contoured jaw end. |
| 16 | Fixed handle. |
| 17 | Base plate affixed to fixed handle. |
| 18 | Work rest anvil. |
| 19 | Spoke head. |
| 20, 20' | Compound leverage arms. |
| 21 | Fixed handle tie plate. |
| 22, 22' | Compound pivots pins. |
| 23 | Fulcrum pivot pin. |
| 24 | Wire spoke wheel. |
| 25 | Spoke clamp apparatus. |
| 26 | Higher leverage spoke clamp apparatus. |

DETAILED DESCRIPTION

Figure 1:
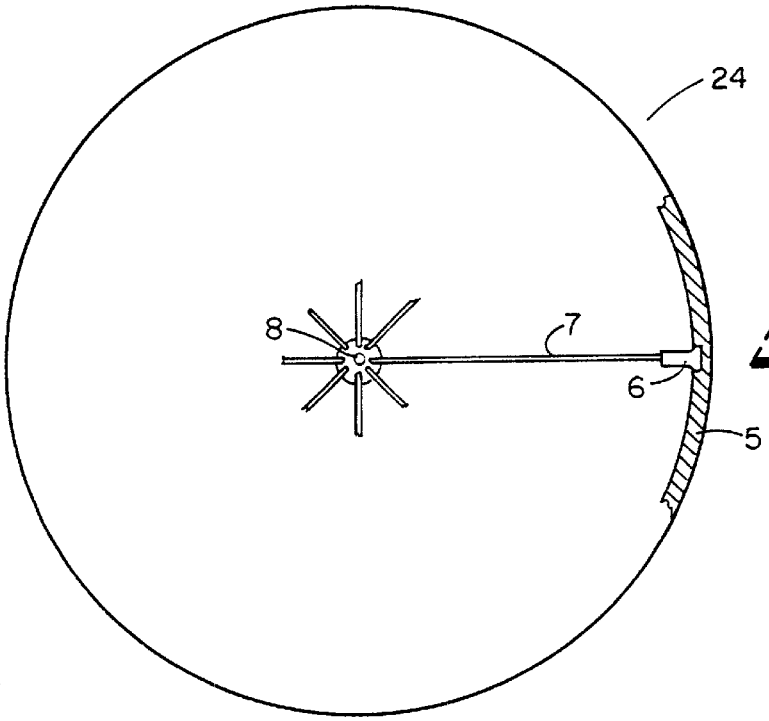
FIG. 1—Spoke wheel.

This invention is to disclose apparatus and method for wire wheel spoke tightening to prevent spoke twist on tightening of the spoke. Referring now to FIG. 1, shows a spoke wheel segment and spoke 7, attached to hub plate 8, and threaded nipple 6 mounted in aperture in rim 5 of spoke wheel 24, and the threaded nipple 6 threaded onto threaded spoke head 19. The threaded nipple 6 mounted in aperture in rim 5, is held in the rim aperture in conventional manner by the head of the nipple 6 having a diameter greater than the aperture diameter in the rim 5 of the spoke wheel 24. On tightening the threaded nipple 6 onto the spoke 7 threaded spoke head 19. the spoke 7 is easily twisted which then causes a problem of non-uniform spoke tension thus causing a warped or wobbly wheel.

Figure 2:
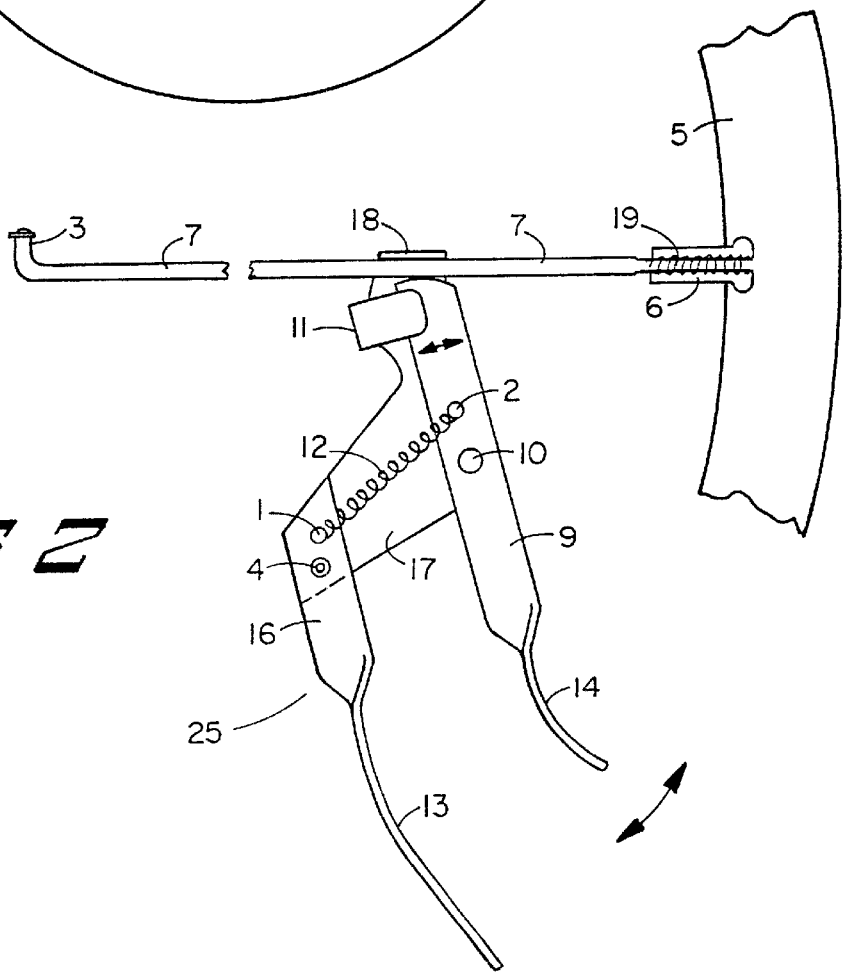
FIG. 2—Spoke clamping tool in operating position.
Figure 3:
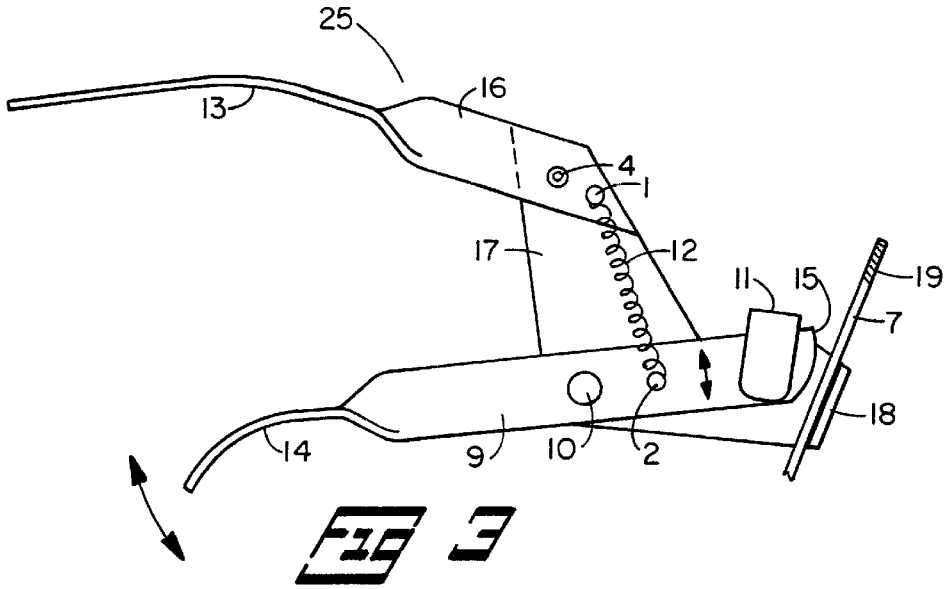
FIG. 3—Plan view of spoke clamping tool and spoke. (First embodiment)

To overcome the above problem of twisted spokes this present application discloses a spoke clamping apparatus 25 as shown in FIG. 3, and FIG. 2 to show the spoke clamping apparatus 25, in position to prevent twisting of spoke 7, when the spoke ell 3 is fitted in hole or aperture in the hub plate 8 of spoke wheel 24 and the threaded nipple 6 mounted in the rim 5 of the spoke wheel is screwed onto the threaded spoke head 19. In FIG. 2, the spoke is shown broken to indicate an indefinite length.

This spoke clamping apparatus includes a fixed handle 16 attached to base plate 17, and a pivoting lever arm 9 mounted on pivot pin 10, and this pivot pin 10 mounted on base plate 17, spring 12 is mounted between spring mount pin 2 on pivot lever arm 9 and spring mount pin 1 attached to fixed handle 16, and serves to open the apparatus to release the contoured jaw end 15 from the spoke 7 held against the work rest anvil 18. Fastener or rivet 4 rigidly attaches fixed handle 16 to base plate 17.

Figure 4:
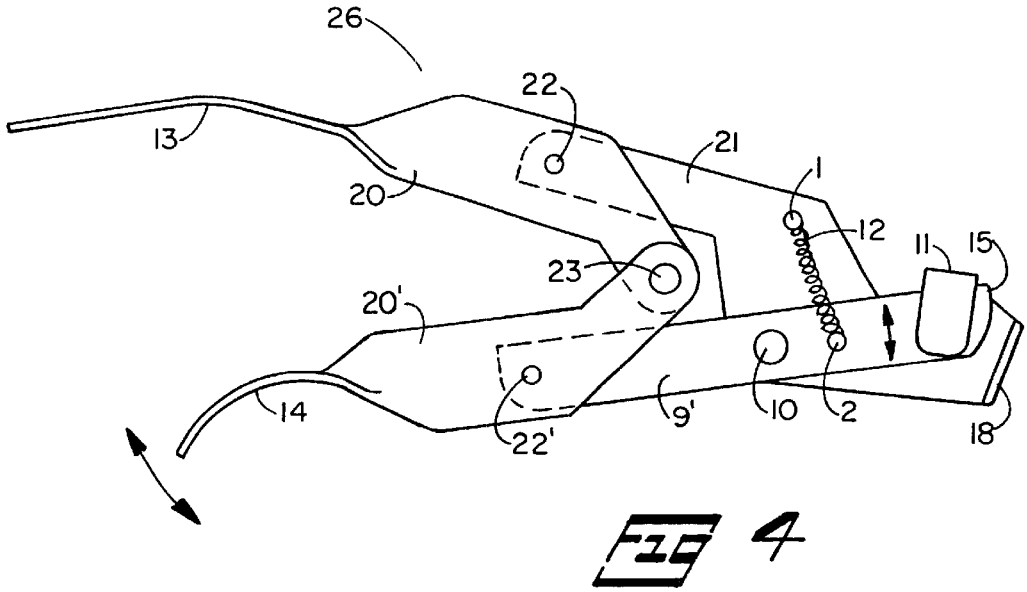
FIG. 4—Compound-leverage spoke clamping tool. (second embodiment)

Referring now to FIG. 4, which shows a spoke clamping apparatus 26 having a higher clamping leverage than spoke clamping apparatus 25 as shown in FIG. 3. As shown in FIG. 4, spoke clamping apparatus 26 has compound leverage arms 20, 20' attached to each other at the fulcrum 23, and fixed handle tie plate 21 attached to compound leverage arm 20 at compound pivot 22, and pivot lever arm 9' attached to compound leverage arm 201 at compound pivot 22' and pivoting lever arm 9' also attached to fixed handle tie plate 21 through pivot pin 10 of lever arm 21. Fulcrum 23 is a pivot point for compound leverage arms 20, 201.

Figure 5:
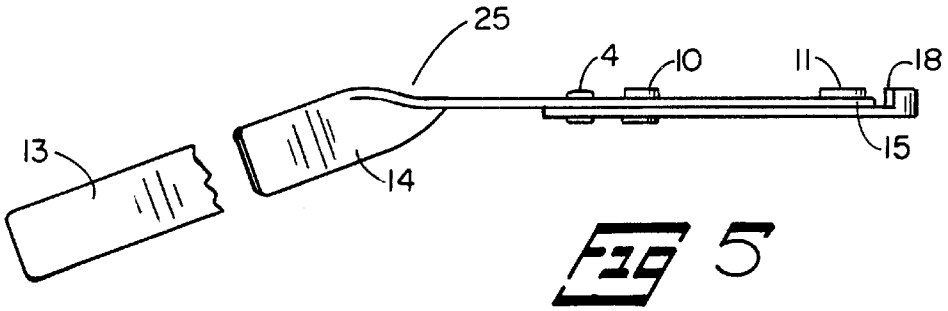
FIG. 5—Side elevation view of spoke clamping tool. (first embodiment)
Figure 6:
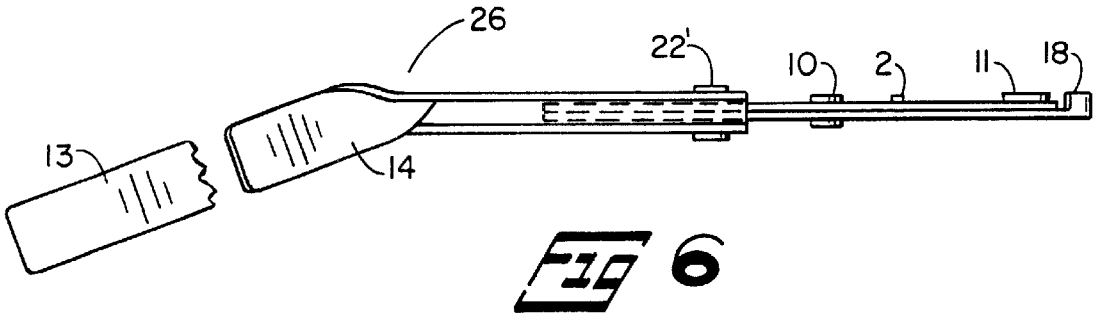
FIG. 6—Side elevation view of compound-leverage spoke clamping tool. (second embodiment)

FIG. 5 is a side elevational view of spoke clamping apparatus 25, and FIG. 3 is a plan view of the same apparatus. FIG. 6 is a side elevational view of spoke clamping apparatus 26, and FIG. 4 is a plan view of the same apparatus.

In each of the embodiments of the apparatus there is a lever arm stop guide 11 which is a bumper to limit the backward movement of the lever arms 9, 9' on releasing the grip on the handles 14, which then allows the spring 12 to activate the backward movement of the lever arms. Also in each of the embodiments in FIGS. 3 and 4 is shown finger grip 13 on the fixed handle 16 of the first embodiment 25, and thumb grip 14 on pivoting lever arm 9, and in the second embodiment finger grip 13 on the compound leverage arm 20, and thumb grip 14 on the compound leverage arm 9'.

In both embodiments of the spoke clamp apparatus the contoured jaw end 15 of pivoting lever arms 9 and 9' has an arc shape to have an interference fit, on maximum pivot of the pivot lever arm, against the anvil which can be identified as a work rest anvil 8, against which a spoke 7 is tightly held, adjacent to the threaded spoke head 19 by the contoured jaw end 15, on closing the grip spanning finger grip 13 and thumb grip 14, as shown in FIG. 2.

Referring now to FIGS. 5 and 6 which shows side elevation views, the spoke 7 is held between work rest anvil 18 and contoured jaw end 15, Also see FIG. 2 with spoke 7 held by the apparatus, and FIG. 3 with spoke 7 in position to be held by hand grip of the apparatus 25 for prevention of twist of the spoke 7 on screwing the threaded nipple 6 onto the threaded spoke head 19.

The above then discloses a method of installing spokes 7 of wire spoke wheels by means of or similar to wheel spoke tightening clamp apparatus 25, 26 holding wire spoke 7 adjacent to thread spoke section 19 of said wire spoke 7, tightening threaded spoke holding nipple 6 on said thread section 19 of spoke 7 while clamping and holding the spoke 7 in the spoke tightening clamp apparatus.

We claim:

1. Wire wheel spoke tightening clamp apparatus comprising, a—a fixed handle and a fastener attaching said fixed handle to a base plate, b—a finger grip on said fixed handle and a work rest anvil attached on the end opposite of said base plate attached to said fixed handle c—a pivot lever arm attached to pivot on said base plate and a thumb grip on one end of said pivot lever arm d—a contoured arc jaw end on said pivot lever arm end opposite said thumb grip end e—a tension spring attached at one end to a spring mount pin mounted on said pivot lever arm and the opposite end of said tension spring attached to spring mount pin attached to said fixed handle, f—a lever arm stop guide attached to said base plate and g—an interference fit between said contoured arc jaw end and said work rest anvil on maximum pivot of said pivot lever arm.

2. Wire wheel spoke tightening clamp apparatus of claim 1, further comprising;

a—compound leverage arms attached to each other through a fulcrum pivot pin b—fixed handle tie plate attached to a pivot pin on one end of one of said compound leverage arms and finger grip attached to other end of one of said compound pivot pins c—a pivoting lever arm attached to a pivot pin on one end of the other of said compound leverage arms d—said pivoting lever arm attached to pivot pin mounted on said fixed handle tie plate.

3. Method of installing spoke of wire spoke wheel comprising;

a—wheel spoke tightening clamp apparatus holding wire spoke adjacent to thread section of said wire spoke b—tightening threaded spoke holding nipple on said thread section of said spoke while clamping and holding said spoke in said spoke tightening clamp apparatus.

* * * * *